US006731246B2

(12) United States Patent
Parsche et al.

(10) Patent No.: US 6,731,246 B2
(45) Date of Patent: May 4, 2004

(54) EFFICIENT LOOP ANTENNA OF REDUCED DIAMETER

(75) Inventors: Francis Parsche, Palm Bay, FL (US); William D. Killen, Melbourne, FL (US); Randy T. Pike, Grant, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/185,251

(22) Filed: Jun. 27, 2002

(65) Prior Publication Data

US 2004/0001029 A1 Jan. 1, 2004

(51) Int. Cl.[7] ..... H01Q 1/38
(52) U.S. Cl. ..... 343/741; 343/788
(58) Field of Search ..... 343/700 MS, 741, 343/742, 743, 748, 866, 895, 787, 788

(56) References Cited

U.S. PATENT DOCUMENTS

| | | | | |
|---|---|---|---|---|
| 3,571,722 A | | 3/1971 | Vendelin | |
| 3,678,418 A | | 7/1972 | Woodward | |
| 4,495,505 A | | 1/1985 | Shields | |
| 4,525,720 A | | 6/1985 | Corzine et al. | |
| 4,800,344 A | | 1/1989 | Graham | |
| 4,825,220 A | | 4/1989 | Edward et al. | |
| 4,882,553 A | | 11/1989 | Davies et al. | |
| 4,916,410 A | | 4/1990 | Littlefield | |
| 4,924,236 A | | 5/1990 | Schuss et al. | |
| 5,039,891 A | | 8/1991 | Wen et al. | |
| 5,148,130 A | | 9/1992 | Dietrich | |
| 5,379,006 A | | 1/1995 | McCorkle | |
| H1460 H | * | 7/1995 | Davis | 343/895 |
| 5,455,545 A | | 10/1995 | Garcia | |
| 5,523,728 A | | 6/1996 | McCorkle | |
| 5,589,842 A | * | 12/1996 | Wang et al. | 343/895 |
| 5,678,219 A | | 10/1997 | Agarwal et al. | |
| 6,052,039 A | | 4/2000 | Chiou et al. | |
| 6,114,940 A | | 9/2000 | Kakinuma et al. | |
| 6,133,806 A | | 10/2000 | Sheen | |
| 6,137,376 A | | 10/2000 | Imbornone et al. | |
| 6,184,845 B1 | | 2/2001 | Leisten et al. | |
| 6,307,509 B1 | | 10/2001 | Krantz | |

OTHER PUBLICATIONS

U.S. patent application Ser. No. 10/448,973, Delgado et al., filed May 30, 2003.
U.S. patent application Ser. No. 10/184,277, Killen, et al., filed Jun. 27, 2002.
U.S. patent application Ser. No. 10/185,443, Killen et al., Jun. 27, 2002.
U.S. patent application Ser. No. 10/184,332, Killen et al., filed Jun. 27, 2002.
U.S. patent application Ser. No. 10/185,847, Killen et al., filed Jun. 27, 2002.
U.S. patent application Ser. No. 10/185,275, Killen et al., filed Jun. 27, 2002.

(List continued on next page.)

*Primary Examiner*—Michael C. Wimer
(74) *Attorney, Agent, or Firm*—Sacco & Associates, PA

(57) ABSTRACT

The invention concerns an efficient loop antenna of reduced size. The antenna is formed on a dielectric substrate disposed on a conductive ground plane. The substrate has a plurality of regions of differing substrate characteristics. An elongated conductive antenna element is arranged in the form of a loop and disposed on a first region of the substrate. The antenna element can have first and second adjacent end portions separated by a gap. The first region of the substrate has a relative permeability that is higher as compared to a second region of the substrate on which the remainder of the circuitry is disposed. According to one aspect of the invention, the relative permeability of the first region is greater than 1.

17 Claims, 3 Drawing Sheets

OTHER PUBLICATIONS

U.S. patent application Ser. No. 10/185,273, Killen et al., filed Jun. 27, 2002.
U.S. patent application Ser. No. 10/308,500, Killen et al., filed Dec. 3, 2002.
U.S. patent application Ser. No. 10/373,935, Killen et al., filed Feb. 25, 2003.
U.S. patent application Ser. No. 10/404,285, Killen et al., filed Mar. 31, 2003.
U.S. patent application Ser. No. 10/404,981, Killen et al., filed Mar. 31, 2003.
U.S. patent application Ser. No. 10/404,960, Killen et al., filed Mar. 31, 2003.
U.S. patent application Ser. No. 10/185,144, Killen et al., filed Jun. 27, 2002.
U.S. patent application Ser. No. 10/185,266, Killen et al., filed Jun. 27, 2002.
U.S. patent application Ser. No. 10/185,162, Rumpf, Jr., et al., filed Jun. 27, 2002.
U.S. patent application Ser. No. 10/185,824, Killen et al., Jun. 27, 2002.
U.S. patent application Ser. No. 10/185,187, Killen et al., Jun. 27, 2002.
U.S. patent application Ser. No. 10/185,855, Killen et al., filed Jun. 27, 2002.
U.S. patent application Ser. No. 10/185,459, Killen et al., Jun. 27, 2002.
U.S. patent application Ser. No. 10/185,480, Killen et al., filed Jun. 27, 2002.
U.S. patent application Ser. No. 10/439,094, Delgado et al., May 15, 2003.

* cited by examiner

EFFICIENT LOOP ANTENNA OF REDUCED DIAMETER

BACKGROUND OF THE INVENTION

1. Statement of the Technical Field

The inventive arrangements relate generally to methods and apparatus for providing increased design flexibility for RF circuits, and more particularly for optimization of dielectric circuit board materials for improved performance.

2. Description of the Related Art

RF circuits, transmission lines and antenna elements are commonly manufactured on specially designed substrate boards. For the purposes of these types of circuits, it is important to maintain careful control over impedance characteristics. If the impedance of different parts of the circuit do not match, this can result in inefficient power transfer, unnecessary heating of components, and other problems. Electrical length of transmission lines and radiators in these circuits can also be a critical design factor.

Two critical factors affecting the performance of a substrate material are dielectric constant (sometimes called the relative permittivity or $\epsilon_r$) and the loss tangent (sometimes referred to as the dissipation factor). The relative permittivity determines the speed of the signal in the substrate material, and therefore the electrical length of transmission lines and other components implemented on the substrate. The loss tangent determines the amount of loss that occurs for signals traversing the substrate material. Losses tend to increase with increases in frequency. Accordingly, low loss materials become even more important with increasing frequency, particularly when designing receiver front ends and low noise amplifier circuits.

Printed transmission lines, passive circuits and radiating elements used in RF circuits are typically formed in one of three ways. One configuration known as microstrip, places the signal line on a board surface and provides a second conductive layer, commonly referred to as a ground plane. A second type of configuration known as buried microstrip is similar except that the signal line is covered with a dielectric substrate material. In a third configuration known as stripline, the signal line is sandwiched between two electrically conductive (ground) planes. In general, the characteristic impedance of a parallel plate transmission line, such as stripline or microstrip, is equal to $\sqrt{L_l/C_l}$ where $L_l$ is the inductance per unit length and $C_l$ is the capacitance per unit length. The values of L, and C, are generally determined by the physical geometry and spacing of the line structure as well as the permittivity of the dielectric material(s) used to separate the transmission line structures. Conventional substrate materials typically have a permeability of 1.

In conventional RF design, a substrate material is selected that has a relative permittivity value suitable for the design. Once the substrate material is selected, the line characteristic impedance value is exclusively adjusted by controlling the line geometry and physical structure.

One problem encountered when designing microelectronic RF circuitry is the selection of a dielectric board substrate material that is optimized for all of the various passive components, radiating elements and transmission line circuits to be formed on the board. In particular, the geometry of certain circuit elements may be physically large or miniaturized due to the unique electrical or impedance characteristics required for such elements. For example, many circuit elements or tuned circuits may need to be an electrical ¼ wave. Similarly, the line widths required for exceptionally high or low characteristic impedance values can, in many instances, be too narrow or too wide for practical implementation for a given substrate. Since the physical size of the microstrip or stripline is inversely related to the relative permittivity of the dielectric material, the dimensions of a transmission line can be affected greatly by the choice of substrate board material.

Still, an optimal board substrate material design choice for components such as antenna feed circuitry may be inconsistent with the optimal board substrate material for other components, such as antenna elements. Moreover, some design objectives for a circuit component may be inconsistent with one another. For example, it may be desirable to reduce the size of an antenna element. In the case of a dipole, this could be accomplished by selecting a board material with a relatively high permittivity. However, the use of a dielectric with a higher relative permittivity will generally have the undesired effect of reducing the radiation efficiency of the antenna.

From the foregoing, it can be seen that the constraints of a circuit board substrate having selected relative dielectric properties often results in design compromises that can negatively affect the electrical performance and/or physical characteristics of the overall circuit. An inherent problem with the conventional approach is that, at least with respect to conventional circuit board substrate, the only control variable for line impedance is the relative permittivity. This limitation highlights an important problem with conventional substrate materials, i.e. they fail to take advantage of the other factor that determines characteristic impedance, namely $L_l$, the inductance per unit length of the transmission line.

Conventional circuit board substrates are generally formed by processes such as casting or spray coating which generally result in uniform substrate physical properties, including the dielectric constant. Accordingly, conventional dielectric substrate arrangements for RF circuits have proven to be a limitation in designing circuits that are optimal in regards to both electrical and physical size characteristics.

SUMMARY OF THE INVENTION

The invention concerns an efficient loop antenna of reduced size. The antenna is formed on a dielectric substrate disposed on a conductive ground plane. The substrate has a plurality of regions of differing substrate characteristics. An elongated conductive antenna element is arranged in the form of a loop and disposed on a first region of the substrate. The antenna element can have first and second adjacent end portions separated by a gap. The first region of the substrate has a relative permeability that is higher as compared to a second region of the substrate on which the remainder of the circuitry is disposed. According to one aspect of the invention, the relative permeability of the first region is greater than 1.

The antenna can also include an input coupler. The input coupler can comprise a conductive line disposed on the substrate adjacent to the antenna element. The input coupler is separated from the antenna element by a coupling space for capacitively coupling to the antenna element an input signal applied to the input coupler. When the input coupler is used in this way, the second end portion of the loop can be connected to the ground plane. The conductive line can extend adjacent to a portion of the antenna element including the first end portion. Further, the input coupler is preferably disposed on a portion of the substrate within a perimeter defined by the antenna element.

A third region of the substrate comprising the coupling space can have a permittivity that is different from the permittivity of the first region of the substrate on which is disposed the antenna element. The permittivity of the third region in that case can be larger as compared to the first region.

According to another aspect of the invention, the antenna element can be divided into a plurality of elongated conductive segments, each having adjacent end portions separated by a characteristic region of the substrate. The characteristic region of the substrate separating the conductive segments can have a permittivity that is different as compared to a permittivity of the characteristic region of the substrate on which is disposed the elongated conductive segments.

DETAILED DESCRIPTION OF THE PREFERRED EMBODIMENTS

Low dielectric constant board materials are ordinarily selected for RF designs. For example, polytetrafluoroethylene (PTFE) based composites such as RT/duroid ® 6002 (dielectric constant of 2.94; loss tangent of 0.009) and RT/duroid ® 5880 (dielectric constant of 2.2; loss tangent of 0.0007) are both available from Rogers Microwave Products, Advanced Circuit Materials Division, 100 S. Roosevelt Ave, Chandler, Ariz. 85226. Both of these materials are common board material choices. The above board materials provide dielectric layers having relatively low dielectric constants with accompanying low loss tangents.

However, use of conventional board materials can compromise the miniaturization of circuit elements and may also compromise some performance aspects of circuits that can benefit from high dielectric constant layers. A typical tradeoff in a communications circuit is between the physical size of antenna elements versus efficiency. By comparison, the present invention provides the circuit designer with an added level of flexibility by permitting use of a dielectric layer portion with selectively controlled permittivity and permeability properties optimized for efficiency and size. This added flexibility enables improved performance and antenna element density not otherwise possible.

Figure 1:
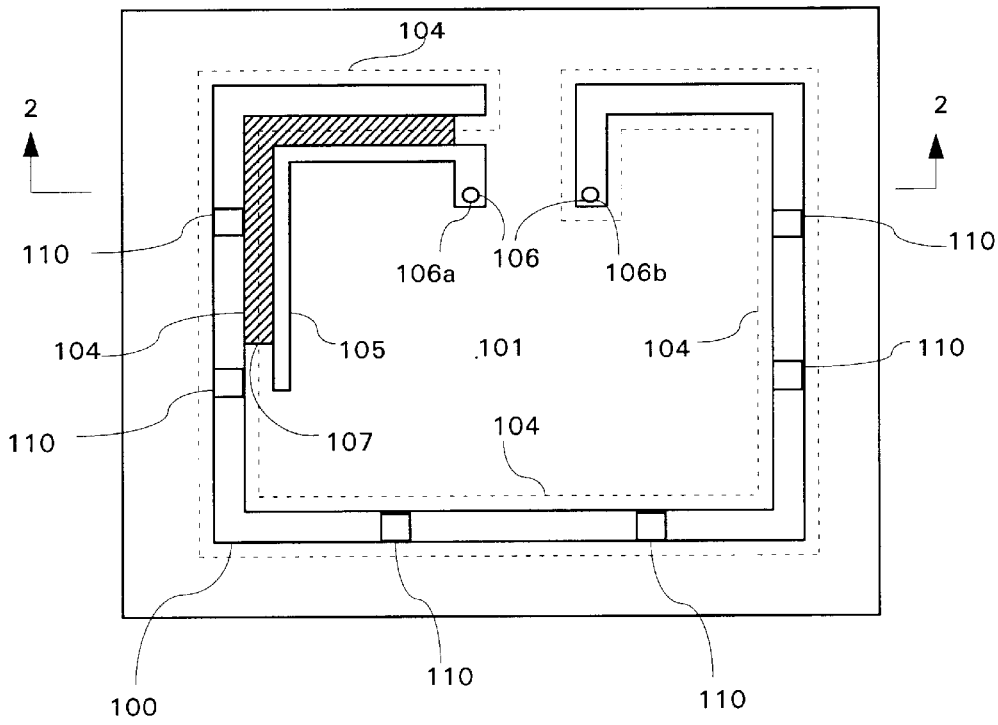
FIG. 1 is a top view of a loop antenna that is useful for understanding the invention.
Figure 2:
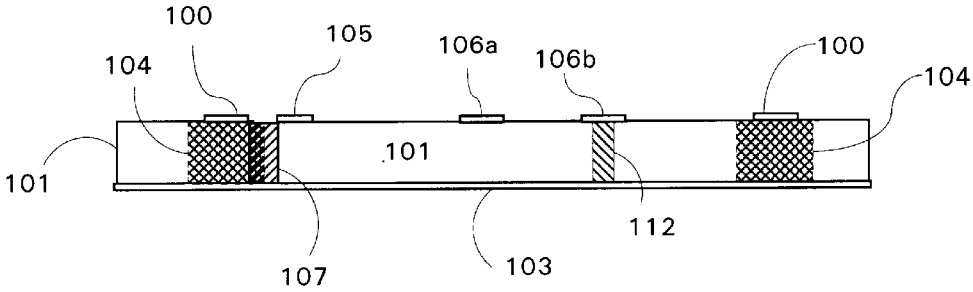
FIG. 2 is a cross-sectional view of FIG. 1 taken along line 2—2.

FIGS. 1 and 2 show a loop antenna element 100 comprised of an elongated conductor is mounted on a dielectric substrate 101. The loop antenna element is not limited to the rectangular shape shown but rather can have any desired geometric form that is otherwise suitable for operation of loop antennas. For example its shape can be square, triangular, trapezoidal, circular, and so on. Opposing ends of the elongated conductor forming the antenna element 100 can be separated by a gap as shown in FIG. 1. A ground plane 103 can be provided beneath the substrate as illustrated. The loop antenna element 100 has a feed point 106 that can be fed coaxially.

Tuning capacitors 110 can be connected in series with the antenna element 100 to improve the current distribution around the loop and to adjust the center frequency of the antenna. The tuning capacitors arranged in this manner are conventional and well known in the art. The capacitors 110 are commonly used to help reduce the overall length or diameter of the antenna element 100 to an arbitrarily small size that is much less than a wavelength at the operating frequency of the antenna. For example, the antenna can be electrically less than one-quarter wavelength and tuned to the operating frequency by adjusting the values of the capacitors 110. The capacitor values are conventionally determined through the use of computer modeling and experimentation.

According to a preferred embodiment, a first side 106*a* of the feed point 106 is connected directly to an input coupler 105. The input coupler provides capacitive coupling along at least one, and preferably two, sides of the loop antenna element 100. The exact dimensions of the input coupler and its spacing from the antenna element 100 will be determined experimentally or by means of computer modeling to achieve an optimum match for the antenna feed circuitry. However, a typical starting point for the dimensions would be to form the segments of the loop between capacitors to be less than one tenth wave-length of the operating frequency. The coupling feed line starting point would be one fourth of the loop circumference. A second side 106*b* of the feed point 106 is connected directly to an opposing end of the loop antenna element 100. Unlike conventional loop arrangements, the second side 106*b* of the feed point 106 that is connected to the end of the loop opposite input coupler 105 is preferably connected to ground by feed-through 112 as shown in FIG. 2.

The input coupler 105 is provided on the substrate for improved input impedance matching. RF energy is capacitively coupled from the input coupler 105 to the adjacent antenna element 100. In conventional loop antenna arrangements, impedance matching circuitry connected to the input of the antenna and adjusted to achieve a proper impedance match with the receiver and/or transmitter. However, one disadvantage of this approach is that input impedance matching tends to interact with the adjustments to the tuning capacitors 110. The result is that adjustments to the operating center frequency of the loop will disturb the matching and vice-versa. In contrast, it has been found that the input impedance measured at feed 106 in FIG. 1 is relatively insensitive to adjustments of tuning capacitors 110. For example, it has been found that the center frequency of the antenna in FIG. 1 can be changed by at least +/−5% without degrading the input matching. The relative insensitivity of the input match to the adjustment of center frequency has been found to be highly advantageous in reducing the number of iterations necessary to achieve a final design configuration.

According to a preferred embodiment of the invention, the amount of capacitive coupling between the antenna element 100 and input coupler 105 can be effectively controlled by selectively altering the permittivity of the substrate 101 in region 107. For example, by increasing the dielectric permittivity in region 107, capacitive coupling can be increased. By controlling the capacitive coupling in this manner, the input impedance at feed point 106 can be varied to provide an improved match to antenna feed circuitry (not shown). Those skilled in the art will recognize that the desired permittivity value for substrate region 107 for a particular antenna design can be determined by computer modeling and/or experimentation to achieve a desired input match for the particular input circuitry and selected loop antenna.

According to a preferred embodiment, the dielectric substrate region 104 beneath the loop antenna element 100 can also have a permeability that is different from the surrounding substrate 101. By modifying the substrate in region 104 for increased permeability, the magnetic coupling to the substrate is increased. This permits a designer to selectively reduce the circumference of the loop while maintaining a high degree of radiation efficiency. Accordingly, increased permeability in region 104 can reduce the diameter or cross-sectional area enclosed by the antenna element 100 for a given operating frequency. The precise value of the permeability will depend upon a variety of factors including the operating frequency, desired bandwidth, and the degree to which the circumference of the loop is to be reduced and other practical limitations.

In the range of operating frequencies from 225–400 Mhz relative permeability values between 4 and 9 are preferred. However, the invention is not limited in this regard.

In the case of loop antennas, it is conventional to interpose capacitors 110 in series along the conductive path defining the radiating element for the loop. However, as the design frequency of the antenna increases, the capacitor values necessary to implement these techniques can become too small to permit use of lumped element components such as chip capacitors. Further, the addition of chip capacitors may create other practical difficulties with the design. In order to overcome these limitations, a further alternative embodiment of the invention is shown in FIGS. 3 and 4.

Figure 3:
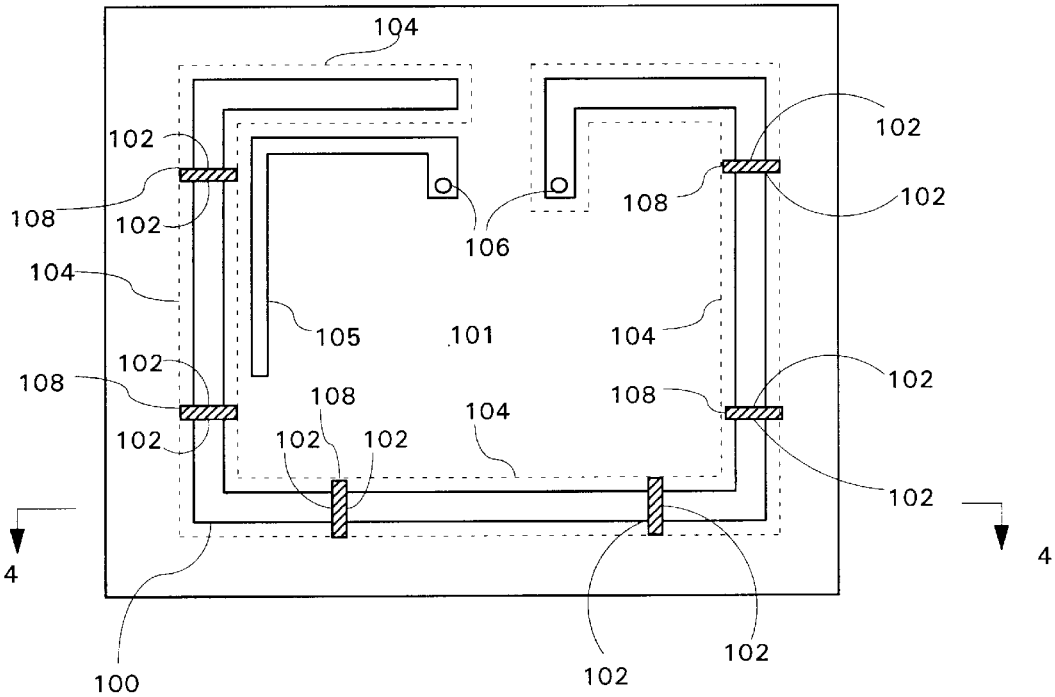
FIG. 3 is a top view of a loop antenna in which a series of reactive elements have been interposed along the length of a loop radiating element.
Figure 4:
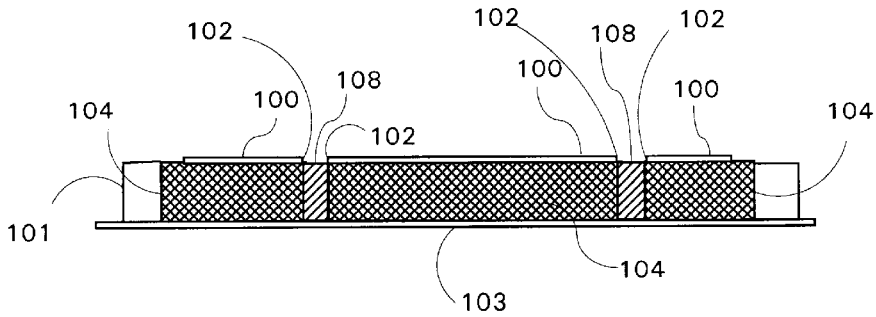
FIG. 4 is a cross-sectional view of FIG. 3 taken along line 4—4.

In FIGS. 3 and 4 common elements already described with regard to FIGS. 1 and 2 are identified using the same reference numbers. In FIGS. 3 and 4, the need for chip capacitors 110 is eliminated. Instead, the necessary capacitance is provided by creating a gap between end portions 102 of the conductive antenna element 100. The result will be some value of inherent capacitance that will exist between the adjacent ends of the antenna element.

One problem with the foregoing approach is that width of the antenna element 100 and the spacing between end portions 102 may not practically permit the designer to achieve the desired amount of capacitive coupling. In order to overcome this problem, the permittivity in regions 108 can be selectively controlled relative to the surrounding substrate. According to a preferred embodiment, the magnetic permeability in regions 108 is not increased in the manner described above with regard to regions 104. Instead, a permeability of 1 is preferably used in regions 108 to minimize any magnetic loading that might otherwise occur.

Control over the permittivity in regions 108 allows the designer to adjust the inherent capacitive coupling that exists between end portions 102. For example, if the permittivity of the substrate in regions 108 is increased, the capacitance between ends 102 can be increased. Those skilled in the art will appreciate that the region 108 can be somewhat smaller than, or can extend somewhat past, the limits defined by end portions 102.

Figure 5:
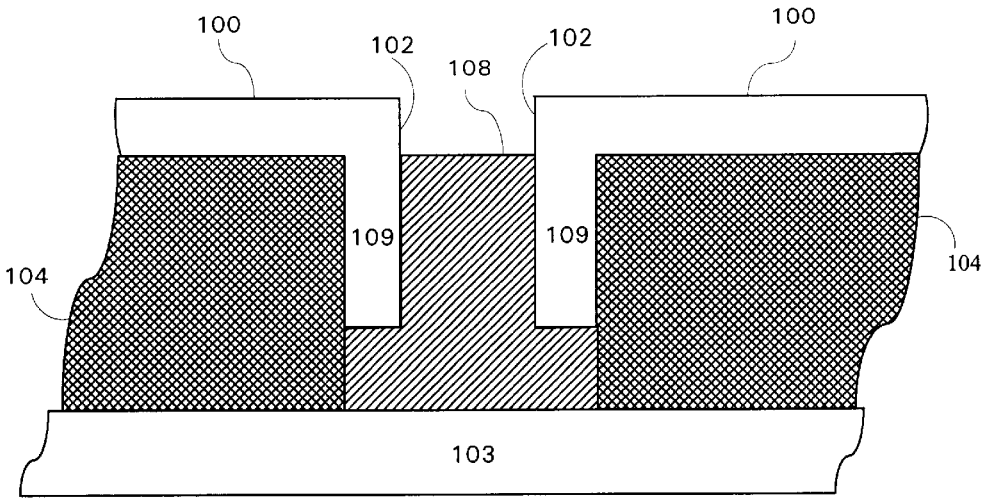
FIG. 5 is an enlarged view of a portion of FIG. 2 showing an alternative embodiment of a capacitor structure.

FIG. 5 is an enlarged view of region 108 showing an alternative embodiment of the invention to permit additional control with respect to capacitive coupling. In FIG. 5 common elements already described with regard to FIGS. 1–4 are identified using the same reference numbers. As show in FIG. 5, tab members 109 can be provided at ends 102 to increase the capacitor plate area for increased capacitance. The addition of these tabs provides the designer with further flexibility for implementing capacitors that are integrated with the substrate. It will be appreciated that the size of the tab members 109 can be selected by the designer to achieve a desired level of capacitance. For example the tabs 109 can extend to a greater or lesser extent within the substrate below the antenna element 100, and the invention is not limited to the precise embodiment illustrated in FIG. 1.

Those skilled in the art will recognize that the foregoing technique is not limited to use with microstrip antennas such as those shown in FIGS. 1–4. Instead, the foregoing technique can be used to produce efficient antenna elements of reduced size in other types of substrate structures. For example, rather than residing exclusively on top of the substrate as shown in FIGS. 1–4, the antenna element 100 can be partially or entirely embedded within the substrate 104.

The inventive arrangements for integrating reactive capacitive and inductive components into a dielectric circuit board substrate are not limited for use with the antennas shown. Rather, the invention can be used with a wide variety of other circuit board components requiring small amounts of carefully controlled inductance and capacitance.

Figure 6:
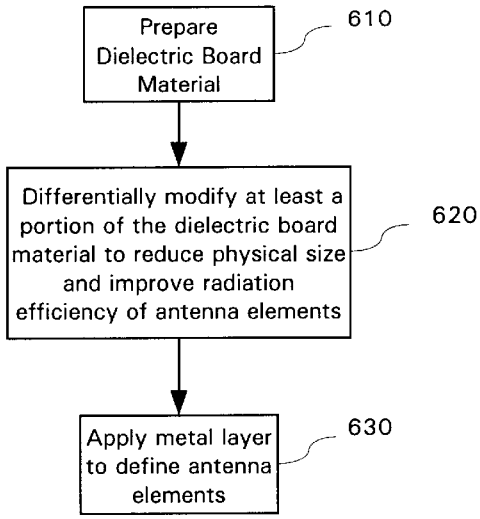
FIG. 6 is a flow chart that is useful for illustrating a process for manufacturing an antenna of reduced physical size and high radiation efficiency.

Dielectric substrate boards having metamaterial portions providing localized and selectable magnetic and dielectric properties can be prepared as shown in FIG. 6. In step 610, the dielectric board material can be prepared. In step 620, at least a portion of the dielectric board material can be differentially modified using meta-materials, as described below, to reduce the physical size and achieve the best possible efficiency for the antenna elements and associated feed circuitry. Finally, in step 630 a metal layer can be applied to define the conductive traces associated with the antenna elements and associated feed circuitry.

As defined herein, the term "metamaterials" refers to composite materials formed from the mixing or arrangement of two or more different materials at a very fine level, such as the Angstrom or nanometer level. Metamaterials allow tailoring of electromagnetic properties of the composite, which can be defined by effective electromagnetic parameters comprising effective electrical permittivity $\in_{eff}$ (or dielectric constant) and the effective magnetic permeability $\mu_{eff}$.

The process for preparing and differentially modifying the dielectric board material as described in steps 610 and 620 shall now be described in some detail. It should be understood, however, that the methods described herein are merely examples and the invention is not intended to be so limited.

Appropriate bulk dielectric substrate materials can be obtained from commercial materials manufacturers, such as DuPont and Ferro. The unprocessed material, commonly called Green Tape™, can be cut into sized portions from a bulk dielectric tape, such as into 6 inch by 6 inch portions. For example, DuPont Microcircuit Materials provides Green Tape material systems, such as 951 Low-Temperature Cofire Dielectric Tape and Ferro Electronic Materials ULF28–30 Ultra Low Fire COG dielectric formulation. These substrate materials can be used to provide dielectric layers having relatively moderate dielectric constants with accompanying relatively low loss tangents for circuit operation at microwave frequencies once fired.

In the process of creating a microwave circuit using multiple sheets of dielectric substrate material, features such as vias, voids, holes, or cavities can be punched through one or more layers of tape. Voids can be defined using mechanical means (e.g. punch) or directed energy means (e.g., laser drilling, photolithography), but voids can also be defined using any other suitable method. Some vias can reach through the entire thickness of the sized substrate, while some voids can reach only through varying portions of the substrate thickness.

The vias can then be filled with metal or other dielectric or magnetic materials, or mixtures thereof, usually using stencils for precise placement of the backfill materials. The individual layers of tape can be stacked together in a conventional process to produce a complete, multi-layer substrate. Alternatively, individual layers of tape can be stacked together to produce an incomplete, multi-layer substrate generally referred to as a sub-stack.

Voided regions can also remain voids. If backfilled with selected materials, the selected materials preferably include metamaterials. The choice of a metamaterial composition can provide tunable effective dielectric constants over a relatively continuous range from less than 2 to about 2650. Tunable magnetic properties are also available from certain metamaterials. For example, through choice of suitable materials the relative effective magnetic permeability generally can range from about 4 to 116 for most practical RF applications. However, the relative effective magnetic permeability can be as low as about 2 or reach into the thousands.

The term "differentially modified" as used herein refers to modifications, including dopants, to a dielectric substrate layer that result in at least one of the dielectric and magnetic properties being different at one portion of the substrate as compared to another portion. A differentially modified board substrate preferably includes one or more metamaterial containing regions.

For example, the modification can be selective modification where certain dielectric layer portions are modified to produce a first set of dielectric or magnetic properties, while other dielectric layer portions are modified differentially or left unmodified to provide dielectric and/or magnetic properties different from the first set of properties. Differential modification can be accomplished in a variety of different ways.

According to one embodiment, a supplemental dielectric layer can be added to the dielectric layer. Techniques known in the art such as various spray technologies, spin-on technologies, various deposition technologies or sputtering can be used to apply the supplemental dielectric layer. The supplemental dielectric layer can be selectively added in localized regions, including inside voids or holes, or over the entire existing dielectric layer. For example, a supplemental dielectric layer can be used for providing a substrate portion having an increased effective dielectric constant.

The differential modifying step can further include locally adding additional material to the dielectric layer or supplemental dielectric layer. The addition of material can be used to further control the effective dielectric constant or magnetic properties of the dielectric layer to achieve a given design objective.

The additional material can include a plurality of metallic and/or ceramic particles. Metal particles preferably include iron, tungsten, cobalt, vanadium, manganese, certain rare-earth metals, nickel or niobium particles. The particles are preferably nanometer size particles, generally having sub-micron physical dimensions, hereafter referred to as nanoparticles.

The particles, such as nanoparticles, can preferably be organofunctionalized composite particles. For example, organofunctionalized composite particles can include particles having metallic cores with electrically insulating coatings or electrically insulating cores with a metallic coating. Magnetic metamaterial particles that are generally suitable for controlling magnetic properties of dielectric layer for a variety of applications described herein include ferrite organoceramics (FexCyHz)-(Ca/Sr/Ba-Ceramic). These particles work well for applications in the frequency range of 8–40 GHz. Alternatively, or in addition thereto, niobium organoceramics (NbCyHz)-(Ca/Sr/Ba-Ceramic) are useful for the frequency range of 12–40 GHz. The materials designated for high frequency are also applicable to low frequency applications. These and other types of composite particles can be obtained commercially.

In general, coated particles are preferable for use with the present invention as they can aid in binding with a polymer (e.g. LCP) matrix or side chain moiety. In addition to controlling the magnetic properties of the dielectric, the added particles can also be used to control the effective dielectric constant of the material. Using a fill ratio of composite particles from approximately 1 to 70%, it is possible to raise and possibly lower the dielectric constant of substrate dielectric layer and/or supplemental dielectric layer portions significantly. For example, adding organofunctionalized nanoparticles to a dielectric layer can be used to raise the dielectric constant of the modified dielectric layer portions.

Particles can be applied by a variety of techniques including polyblending, mixing and filling with agitation. For example, if the dielectric layer includes a LCP, the dielectric constant may be raised from a nominal LCP value of 2 to as high as 10 by using a variety of particles with a fill ratio of up to about 70%.

Metal oxides useful for this purpose can include aluminum oxide, calcium oxide, magnesium oxide, nickel oxide, zirconium oxide and niobium (II, IV and V) oxide. Lithium niobate ($LiNbO_3$), and zirconates, such as calcium zirconate and magnesium zirconate, also may be used.

The selectable dielectric properties can be localized to areas as small as about 10 nanometers, or cover large area regions, including the entire board substrate surface. Conventional techniques such as lithography and etching along with deposition processing can be used for localized dielectric and magnetic property manipulation.

Materials can be prepared mixed with other materials or including varying densities of voided regions (which generally introduce air) to produce effective dielectric constants in a substantially continuous range from 2 to about 2650, as well as other potentially desired substrate properties. For example, materials exhibiting a low dielectric constant (<2 to about 4) include silica with varying densities of voided regions. Alumina with varying densities of voided regions can provide a dielectric constant of about 4 to 9. Neither silica nor alumina have any significant magnetic permeability. However, magnetic particles can be added, such as up to 20 wt. %, to render these or any other material significantly magnetic. For example, magnetic properties may be tailored with organofunctionality. The impact on dielectric constant from adding magnetic materials generally results in an increase in the dielectric constant.

Medium dielectric constant materials have a dielectric constant generally in the range of 70 to 500+/−10%. As noted above these materials may be mixed with other materials or voids to provide desired effective dielectric constant values. These materials can include ferrite doped calcium titanate. Doping metals can include magnesium, strontium and niobium. These materials have a range of 45 to 600 in relative magnetic permeability.

For high dielectric constant applications, ferrite or niobium doped calcium or barium titanate zirconates can be used. These materials have a dielectric constant of about 2200 to 2650. Doping percentages for these materials are generally from about 1 to 10%. As noted with respect to other materials, these materials may be mixed with other materials or voids to provide desired effective dielectric constant values.

These materials can generally be modified through various molecular modification processing. Modification processing can include void creation followed by filling with materials such as carbon and fluorine based organo functional materials, such as polytetrafluoroethylene PTFE.

Alternatively or in addition to organofunctional integration, processing can include solid freeform fabrication (SFF), photo, uv, x-ray, e-beam or ion-beam irradiation. Lithography can also be performed using photo, uv, x-ray, e-beam or ion-beam radiation.

Different materials, including metamaterials, can be applied to different areas on substrate layers (sub-stacks), so that a plurality of areas of the substrate layers (sub-stacks) have different dielectric and/or magnetic properties. The backfill materials, such as noted above, may be used in conjunction with one or more additional processing steps to attain desired, dielectric and/or magnetic properties, either locally or over a bulk substrate portion.

A top layer conductor print is then generally applied to the modified substrate layer, sub-stack, or complete stack. Conductor traces can be provided using thin film techniques, thick film techniques, electroplating or any other suitable technique. The processes used to define the conductor pattern include, but are not limited to standard lithography and stencil.

A base plate is then generally obtained for collating and aligning a plurality of modified board substrates. Alignment holes through each of the plurality of substrate boards can be used for this purpose.

The plurality of layers of substrate, one or more sub-stacks, or combination of layers and sub-stacks can then be laminated (e.g. mechanically pressed) together using either isostatic pressure, which puts pressure on the material from all directions, or uniaxial pressure, which puts pressure on the material from only one direction. The laminate substrate is then is further processed as described above or placed into an oven to be fired to a temperature suitable for the processed substrate (approximately 850 C. to 900 C. for the materials cited above).

The plurality of ceramic tape layers and stacked sub-stacks of substrates can then be fired, using a suitable furnace that can be controlled to rise in temperature at a rate suitable for the substrate materials used. The process conditions used, such as the rate of increase in temperature, final temperature, cool down profile, and any necessary holds, are selected mindful of the substrate material and any material backfilled therein or deposited thereon. Following firing, stacked substrate boards, typically, are inspected for flaws using an optical microscope.

The stacked ceramic substrates can then be optionally diced into cingulated pieces as small as required to meet circuit functional requirements. Following final inspection, the cingulated substrate pieces can then be mounted to a test fixture for evaluation of their various characteristics, such as to assure that the dielectric, magnetic and/or electrical characteristics are within specified limits.

Thus, dielectric substrate materials can be provided with localized tunable dielectric and/or magnetic characteristics for improving the density and performance of circuits. The dielectric flexibility allows independent optimization of the circuit elements.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

What is claimed is:

1. An efficient loop antenna of reduced size, comprising:

a dielectric substrate disposed on a conductive ground plane, said substrate having a plurality of regions of differing substrate characteristics;

an elongated conductive antenna element arranged in the form of a loop and disposed on a first region of said substrate;

said first region of said substrate having a relative permeability that is higher as compared to a second region of said substrate.

2. The antenna element according to claim 1 wherein said relative permeability of said first region is greater than 1.

3. An efficient loop antenna of reduced size, comprising:

a dielectric substrate disposed on a conductive ground plane, said substrate having a plurality of regions of differing substrate characteristics;

an elongated conductive antenna element arranged in the form of a loop and disposed on a first region of said substrate, said first region of said substrate having a relative permeability that is higher as compared to a second region of said substrate; and an input coupler, said input coupler comprising a conductive line disposed on said substrate adjacent to said antenna element and separated from said antenna element by a coupling space for coupling to said antenna element an input signal applied to said input coupler.

4. The antenna according to claim 3 wherein said antenna element has first and second adjacent end portions separated by a gap, said second end portion connected to said ground plane.

5. The antenna according to claim 4 wherein said conductive line extends adjacent to a portion of said antenna element including said first end portion.

6. The antenna according to claim 3 wherein said input coupler is disposed on a portion of the substrate within a perimeter defined by said antenna element.

7. The antenna according to claim 3 wherein a third region of said substrate comprising said coupling space has a permittivity that is different from the permittivity of said first region of said substrate on which is disposed said antenna element.

8. The antenna according to claim 7 wherein said permittivity of said third region is larger as compared to said first region.

9. An efficient loop antenna of reduced size, comprising:

a dielectric substrate disposed on a conductive around plane, said substrate having a plurality of regions of differing substrate characteristics; and an elongated conductive antenna element arranged in the form of a loop and disposed on a first region of said substrate, said first region of said substrate having a relative permeability that is higher as compared to a second region of said substrate;

wherein said antenna element is divided into a plurality of elongated conductive segments, each having adjacent end portions separated by a third characteristic region of said substrate, said third characteristic region of said substrate having a permittivity that is larger than a permittivity of said second characteristic region of said substrate on which is disposed said elongated conductive segments.

10. A printed circuit antenna with broadband input coupling, comprising:

a dielectric substrate disposed on a conductive ground plane; and an elongated conductive antenna element arranged in the form of a loop and disposed on said substrate, said antenna element having first and second adjacent end portions separated by a gap, said antenna element disposed on a first region of said substrate having a permeability larger than a second region surrounding said antenna element.

11. The antenna according to claim 10 further comprising a third region of said substrate on which an input coupler is disposed, said third region having a relative permeability that is smaller than the relative permeability of said first region of said substrate.

12. The antenna element according to claim 10 wherein said relative permeability of said first region is greater than 1.

13. The antenna element according to claim 10 wherein said antenna element is divided into a plurality of elongated conductive segments, each having adjacent end portions separated by a third characteristic region of said substrate, said third characteristic region of said substrate having a permittivity that is larger than a permittivity of said first region of said substrate on which are disposed said elongated conductive segments.

14. A printed circuit antenna with broadband input coupling, comprising:

a dielectric substrate disposed on a conductive ground plane;

an elongated conductive antenna element arranged in the form of a loop and disposed on said substrate, said antenna element having first and second adjacent end portions separated by a gap, said antenna element disposed on a first region of said substrate having a permeability larger than a second region surrounding said antenna element; and an input coupler is disposed on a third region of said substrate, said third region having a relative permeability that is smaller than the relative permeability of said first region of said substrate.

15. A printed circuit antenna with broadband input coupling, comprising:

a dielectric substrate disposed on a conductive ground plane; and an elongated conductive antenna element arranged in the form of a loop and disposed on said substrate, said antenna element having first and second adjacent end portions separated by a gap, said antenna element disposed on a first region of said substrate having a permeability larger than a second region surrounding said antenna element;

wherein said antenna element is divided into a plurality of elongated conductive segments, each having adjacent end portions separated by a third characteristic region of said substrate, said third characteristic region of said substrate having a permittivity that is larger than a permittivity of said first region of said substrate on which are disposed said elongated conductive segments.

16. A loop antenna, comprising:

a dielectric substrate disposed on a conductive ground plane, said substrate having a plurality of regions of differing substrate characteristics;

an elongated conductive antenna element arranged in the form of a loop and disposed on a first region of said substrate;

wherein said antenna element is divided into a plurality of elongated conductive segments, each having adjacent end portions separated by a second characteristic region of said substrate, said second characteristic region of said substrate having a permittivity that is larger than a permittivity of said first region of said substrate on which are disposed said elongated conductive segments.

17. The loop antenna of claim 16 further comprising at least one tab member affixed to each of at least two of said end portions, said tab members being disposed in an opposing configuration to provide increased capacitance between said end portions.

* * * * *

UNITED STATES PATENT AND TRADEMARK OFFICE

CERTIFICATE OF CORRECTION

PATENT NO. : 6,731,246 B2
DATED : May 4, 2004
INVENTOR(S) : Parsche et al.

It is certified that error appears in the above-identified patent and that said Letters Patent is hereby corrected as shown below:

Column 10,
Line 62, delete “around” and replace with -- ground --.

Signed and Sealed this

Sixteenth Day of November, 2004

JON W. DUDAS
*Director of the United States Patent and Trademark Office*